US006690248B2

(12) United States Patent
Kawanami

(10) Patent No.: US 6,690,248 B2
(45) Date of Patent: Feb. 10, 2004

(54) NONRECIPROCAL CIRCUIT DEVICE INCLUDING PORTS HAVING DIFFERENT CHARACTERISTIC IMPEDANCES AND COMMUNICATION APPARATUS INCLUDING SAME

(75) Inventor: Takashi Kawanami, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/170,649

(22) Filed: Jun. 14, 2002

(65) Prior Publication Data

US 2003/0011439 A1 Jan. 16, 2003

(30) Foreign Application Priority Data

Jun. 27, 2001 (JP) ..... 2001-194512
Apr. 23, 2002 (JP) ..... 2002-121116

(51) Int. Cl.[7] ..... H01P 1/36
(52) U.S. Cl. ..... 333/24.2; 333/1.1
(58) Field of Search ..... 333/24.2, 1.1, 333/32, 193; 252/62.57

(56) References Cited

U.S. PATENT DOCUMENTS 5,638,032 A * 6/1997 Hasegawa ..... 333/24.2
5,786,736 A * 7/1998 Dejima et al. ..... 333/24.2
5,923,224 A * 7/1999 Makino et al. ..... 333/24.2
5,923,228 A * 7/1999 Okada et al. ..... 333/109
5,945,887 A * 8/1999 Makino et al. ..... 333/24.2
6,020,793 A * 2/2000 Makino et al. ..... 333/24.2
6,037,844 A * 3/2000 Makino et al. ..... 333/24.2
6,087,905 A * 7/2000 Makino et al. ..... 333/24.2
6,420,941 B2 * 7/2002 Okada et al. ..... 333/24.2
6,522,216 B2 * 2/2003 Makino et al. ..... 333/24.2
6,549,086 B2 * 4/2003 Kawanami ..... 333/24.2
6,580,333 B2 * 6/2003 Hasegawa ..... 333/24.2
6,590,467 B2 * 7/2003 Hasegawa ..... 333/24.2
6,597,252 B1 * 7/2003 Okada et al. ..... 333/24.2
6,614,324 B2 * 9/2003 Ohira et al. ..... 333/24.2
6,624,713 B2 * 9/2003 Matsunaga et al. ..... 333/1.1
6,625,869 B2 * 9/2003 Jodo ..... 333/1.1

* cited by examiner

*Primary Examiner*—Michael Tokar
*Assistant Examiner*—Lam T. Mai
(74) *Attorney, Agent, or Firm*—Keating & Bennett, LLP

(57) ABSTRACT

An isolator (a nonreciprocal circuit device) includes a magnetic assembly defined by center conductors for an input port, for an output port, and for a terminating port, and a ferrite member, a permanent magnet, and a spacer, all of which are provided in a housing. A series capacitor and a parallel capacitor are connected to the center conductor for the input port. A parallel capacitor is connected to the center conductor for the output port. A parallel capacitor and a resistor, which defines a terminating resistor, are connected to the center conductor for the terminating port. The center conductor for the input port has a width greater than that of the other center conductors. Thus, the characteristic impedance and the inductance of the center conductor for the input port are reduced to provide a wide operating frequency band. An equivalent series resistance is reduced to achieve a reduction in loss.

16 Claims, 15 Drawing Sheets

NONRECIPROCAL CIRCUIT DEVICE INCLUDING PORTS HAVING DIFFERENT CHARACTERISTIC IMPEDANCES AND COMMUNICATION APPARATUS INCLUDING SAME

BACKGROUND OF THE INVENTION

1. Field of the Invention

The present invention relates to a nonreciprocal circuit device for use in, for example, a microwave band and also relates to a communication apparatus including such a nonreciprocal circuit device.

2. Description of the Related Art

An exemplary isolator, which is a nonreciprocal circuit device, according to the related art will now be described with reference to FIGS. 11, 12A, and 12B.

FIG. 11 is an exploded perspective view of an isolator according to the related art, FIG. 12A is a sectional plan thereof, and FIG. 12B is an equivalent circuit diagram thereof.

Referring to FIGS. 11, 12A, and 12B, reference numeral 1 indicates a ferrite member, 2 generally indicates center conductors (2*a* is a center conductor for an input port, 2*b* is a center conductor for an output port, and 2*c* is a center conductor for a terminating port), 3 is a magnetic assembly, 4 is a housing, 5 is an upper yoke, 6 is a permanent magnet, 7 is a spacer, 8 is a lower yoke, 9 is an input terminal, 10 is an output terminal, 11 are ground terminals, R is a resistor, $C_1$, $C_2$, and $C_3$ are capacitors, and H indicates the direction of a magnetic field applied to the ferrite member 1.

The center conductors 2 are defined by the center conductor 2*a* for an input port (input-port center conductor 2*a*), the center conductor 2*b* for an output port (output-port center conductor 2*b*), and the center conductor 2*c* for a terminating port (terminating-port center conductor 2*c*). The center conductors 2*a* to 2*c* are arranged so as to cross one another on the ferrite member 1. The center conductors 2*a* to 2*c* and the ferrite member 1 define the magnetic assembly 3.

The housing 4 is provided with the lower yoke 8, the input terminal 9, the output terminal 10, and the plurality of ground terminals 11. The housing 4 accommodates the magnetic assembly 3, the permanent magnet 6 for applying a static magnetic field to the magnetic assembly 3, the spacer 7 separating the magnetic assembly 3 and the permanent magnet 6, the capacitors $C_1$, $C_2$, and $C_3$, which define matching elements, and the resistor R, which defines a terminating resistor. The upper yoke 5 covers the upper portion of the housing 4.

In the housing 4, the capacitor $C_3$ and the resistor R are connected to one end of the terminating-port center conductor 2*c*. The capacitors $C_1$ and $C_2$ are connected to the input-port center conductor 2*a* and the output-port center conductor 2*b*, respectively. The center conductors 2*a* to 2*c*, the capacitors $C_1$ to $C_3$, and the resistor R are connected to the corresponding ground terminals 11 provided in the housing 4. An input port 109 is arranged such that one end of the input-port center conductor 2*a* is connected to the input terminal 9 and the capacitor $C_1$ is connected between the one end of the input-port center conductor 2*a* and the corresponding ground terminal 11. An output port 110 is arranged such that one end of the output-port center conductor 2*b* is connected to the output terminal 10 and the capacitor $C_2$ is connected between the one end of the output-port center conductor 2*b* and the corresponding ground terminal 11. In addition, a terminating port 111 is arranged such that the capacitor $C_3$ and the resistor R are connected in parallel between the terminating-port center conductor 2*c* and the corresponding ground terminals 11.

In this state, an electromagnetic wave entering from the input terminal 9 is output from the output terminal 10, while an electromagnetic wave entering from the output terminal 10 is absorbed by the resistor R of the terminating port 111, and thus, is not output to the input terminal 9, thereby functioning as an isolator.

However, such a nonreciprocal circuit device of the related art has the following deficiencies.

Typically, in a mobile communication apparatus, and particularly a battery-operated communication apparatus, such as a portable communication apparatus, active elements such as a transistor for a power amplifier, are operated by, for example, a power supply having a low voltage of about 3 V to about 4.5 V. When 1 watt of power is required in such a low voltage operation, the load impedance of the active element is about 3Ω to about 5Ω. On the other hand, an antenna, antenna duplexer, and switch are typically configured to have a characteristic impedance of about 50Ω.

An isolator, which defines a nonreciprocal circuit device, is provided adjacent to the output of the power amplifier, and is used to prevent an increase in power consumption due to stabilizing the operation of the radio wave transmitter or inhibiting load fluctuation, or to prevent the output distortion factor from deteriorating. In this case, since the isolator is configured to have a characteristic impedance of about 50Ω, the power amplifier to be connected to the isolator must include a circuit for converting the 3Ω to 5Ω impedance of the active element of the isolator to the 50Ω impedance of the isolator, such that the return loss does not increase at the input of the isolator. Thus, such a converter circuit has commonly been provided inside or outside a power amplifier. However, the converter circuit experiences problems such as transmission loss, a reduced operating frequency band, and an increased size (required for the space of the converter circuit).

SUMMARY OF THE INVENTION

In order to overcome the problems described above, preferred embodiments of the present invention provide a compact and low-loss nonreciprocal circuit device that permits direct connection of a low impedance element to the input port without providing an impedance converter circuit, and that permits connection of a low impedance element having a greatly simplified matching circuit as compared to the related art to the input port. Also, other preferred embodiments of the present invention provide a communication apparatus including such a novel nonreciprocal circuit device.

According to a preferred embodiment of the present invention, a nonreciprocal circuit device includes a magnetic assembly in which a center conductor for an input port and center conductors for the other ports are disposed on a ferrite member so as to cross one another. The nonreciprocal circuit device further includes a permanent magnet for applying a static magnetic field to the magnetic assembly, and matching circuits connected to the corresponding center conductors. When the center conductors for the input port and the other ports are viewed as lines, the characteristic impedance of the center conductor for the input port is less than the characteristic impedance of the center conductors for the other ports. This arrangement provides a low-loss wide-band nonreciprocal circuit device having a low input-impedance.

Thus, even when a low-impedance circuit element (e.g., a power amplifier) is connected to a stage prior to the nonreciprocal circuit device, low-loss signal transmission is achieved.

Preferably, the matching circuit connected to the center conductor for the input port includes a series capacitor connected in series to the center conductor for the input port and a parallel capacitor connected between the center conductor for the input port and a ground electrode. This arrangement provides a nonreciprocal circuit device having greatly improved characteristics of impedance matching, input return loss, isolation, and insertion loss over the wider frequency band.

Preferably, the width of the center conductor for the input port is greater than the width of the center conductors for the other ports. This configuration provides a low-loss, wide-band nonreciprocal circuit device having a low input-impedance.

The center conductor for the input are preferably defined by a single conductor element that extends in the width direction thereof, and the center conductors for the other ports are each preferably defined by a plurality of conductor elements that are substantially parallel to each other. The width of the single conductor element defining the center conductor for the input port is preferably greater than the combined total width of the conductor elements defining each of the center conductors for the other ports. This configuration provides a low-loss, wide-band nonreciprocal circuit device having a low input-impedance.

Each of the center conductors for the input port and for the other ports may be defined by a plurality of conductor elements that are substantially parallel to each other. The number of conductor elements defining the center conductor for the input port is greater than the number of conductor elements defining each of the center conductors for the other ports. The combined total width of the conductor elements defining the center conductor for the input port is preferably greater than the combined total width of the conductor elements defining each of the center conductors for the other ports. This configuration provides a low-loss, wide-band nonreciprocal circuit device having a low input-impedance.

Preferably, the center conductor for the input port has a thickness that is greater than the thickness of the center conductors for the other ports. This configuration provides a low-loss, wide-band nonreciprocal circuit device having a low input-impedance. In addition, this arrangement achieves a low input-impedance without varying the width of any of the conductor elements.

Preferably, the characteristic impedance of the center conductor for the input port is about 3Ω to about 30Ω. With this arrangement, even when the nonreciprocal circuit device is directly connected to a power amplifier circuit and a filter circuit, or is connected to a power amplifier and a filter having a simplified and low-loss matching circuit as compared to a conventionally-used matching circuit, low-loss signal transmission is achieved.

Preferably, the characteristic impedance of the center conductors for the other ports is about 50Ω. This allows matching with elements, such as an antenna duplexer and antenna, of a communication system, to thereby achieve a low-loss signal transmission. Additionally, this arrangement provides an output return loss characteristic having an increased frequency band.

Preferably, one of the center conductors for the other ports is terminated. This arrangement provides a low-loss isolator.

According to another preferred embodiment of the present invention, a communication apparatus is provided that includes the nonreciprocal circuit device according to the first preferred embodiment of the present invention. This provides a communication apparatus having greatly reduced transmission loss.

Other feature, elements, characteristics and advantages of the present invention will become more apparent from the following detailed description of preferred embodiments of the present invention with reference to the attached drawings.

DETAILED DESCRIPTION OF PREFERRED EMBODIMENTS

A nonreciprocal circuit device according to a first preferred embodiment of the present invention will now be described with reference to FIGS. 1 to 3.

Figure 1:
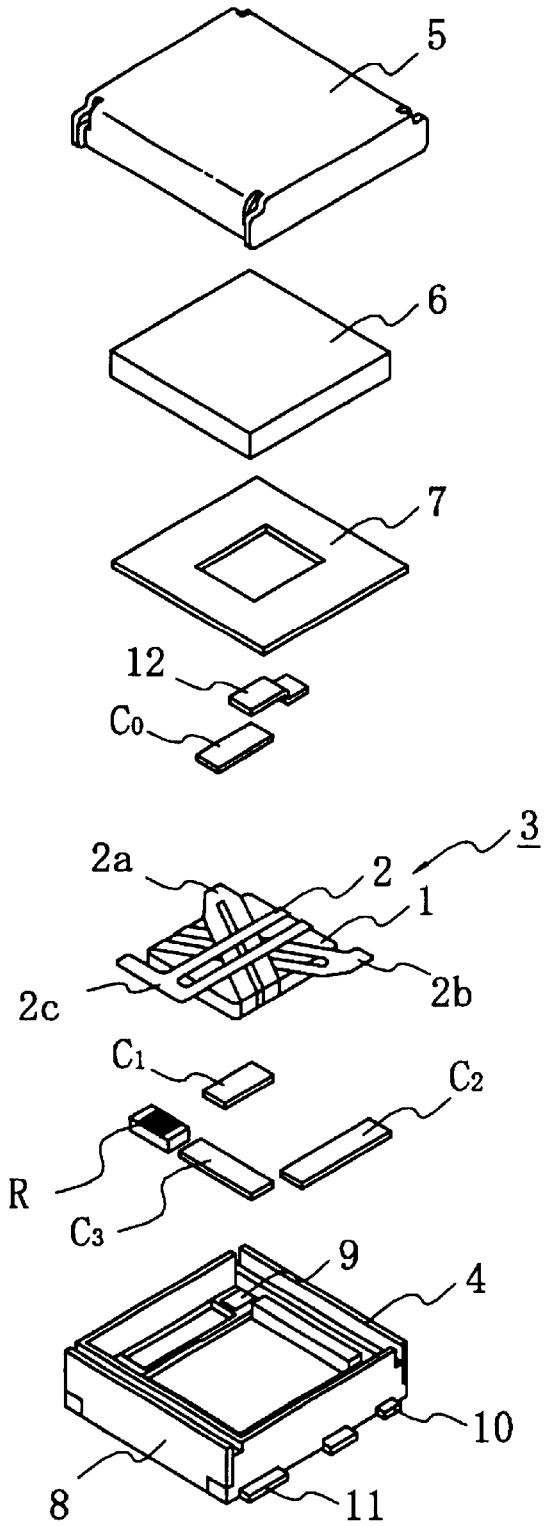
FIG. 1 is an exploded perspective view of an isolator according to a first preferred embodiment of the present invention.
Figure 2:
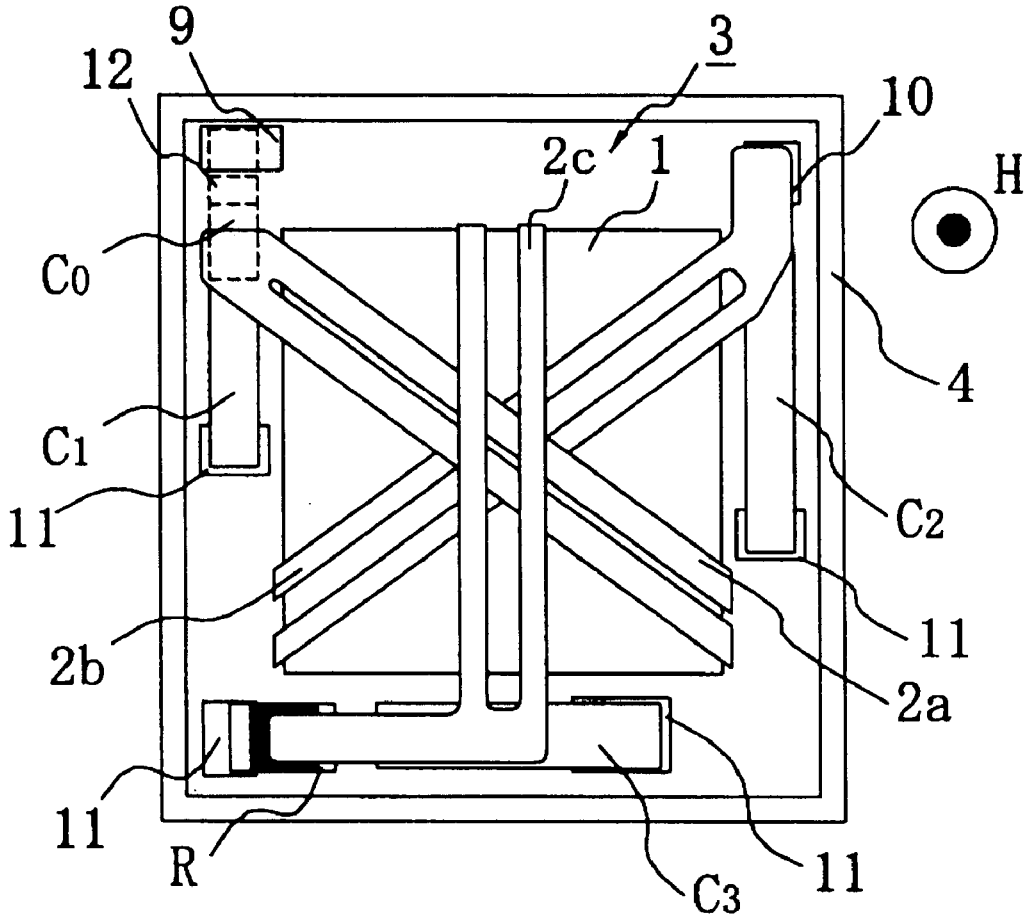
FIG. 2 is a sectional plan view of the isolator according to the first preferred embodiment of the present invention.
Figure 3:
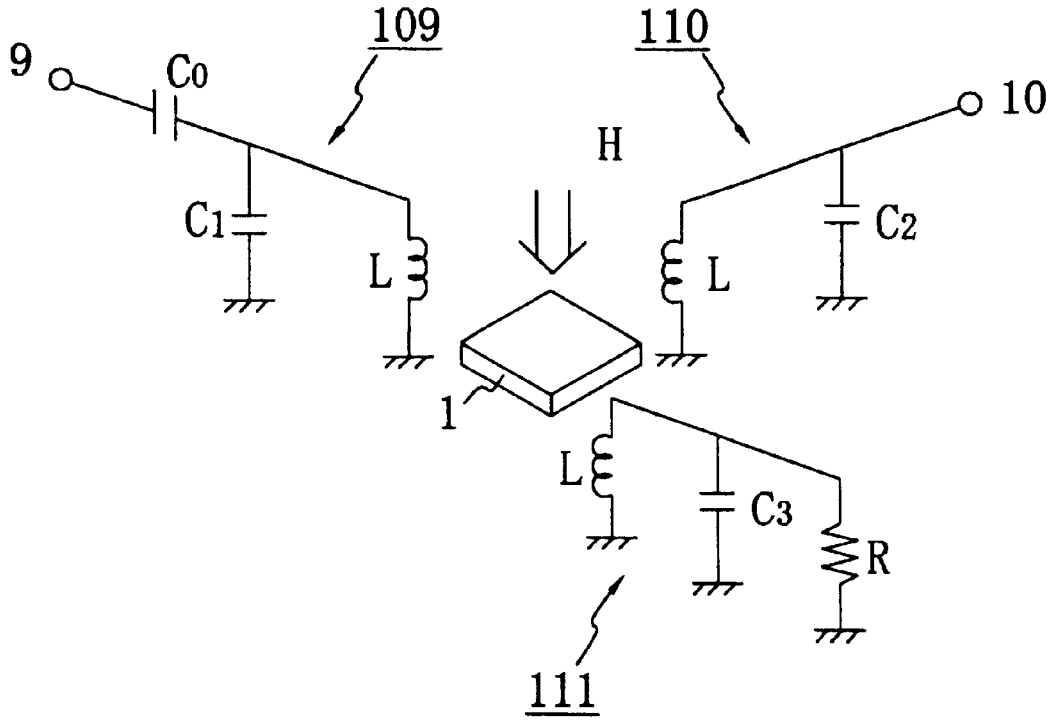
FIG. 3 is an equivalent circuit diagram of the isolator according to the first preferred embodiment of the present invention.
Figure 4A:
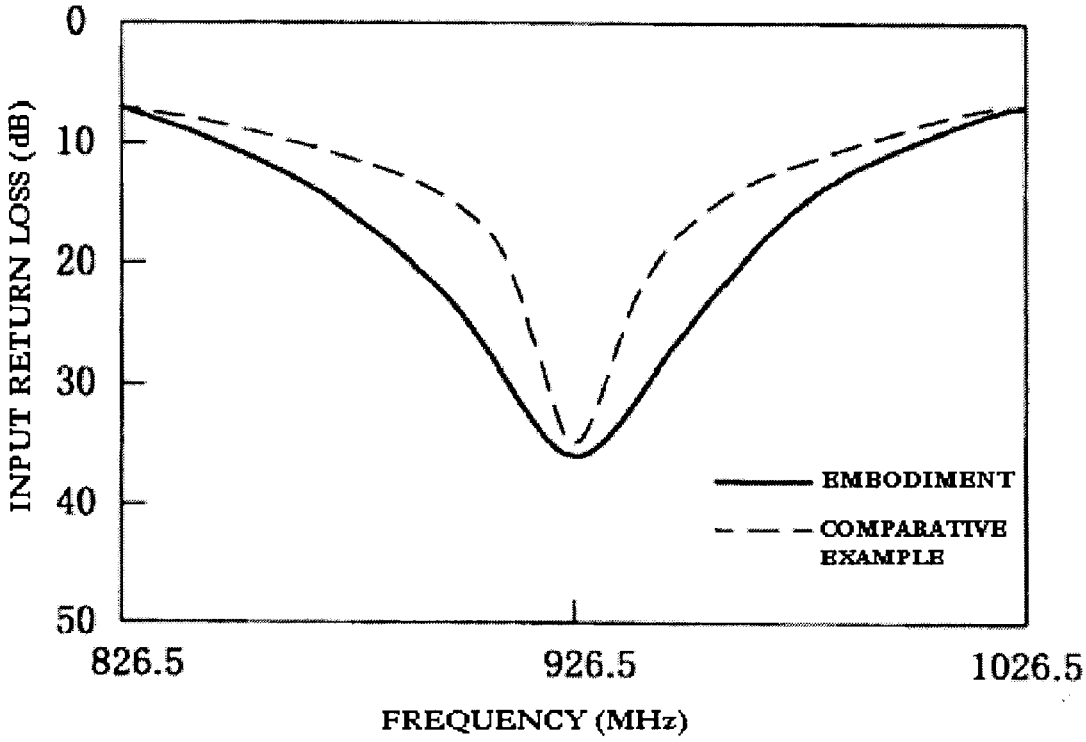
FIGS. 4A and 4B are graphs showing the frequency characteristics of the input return loss and the isolation, respectively, of the isolator of a preferred embodiment of the present invention and a comparative example.
Figure 4B:
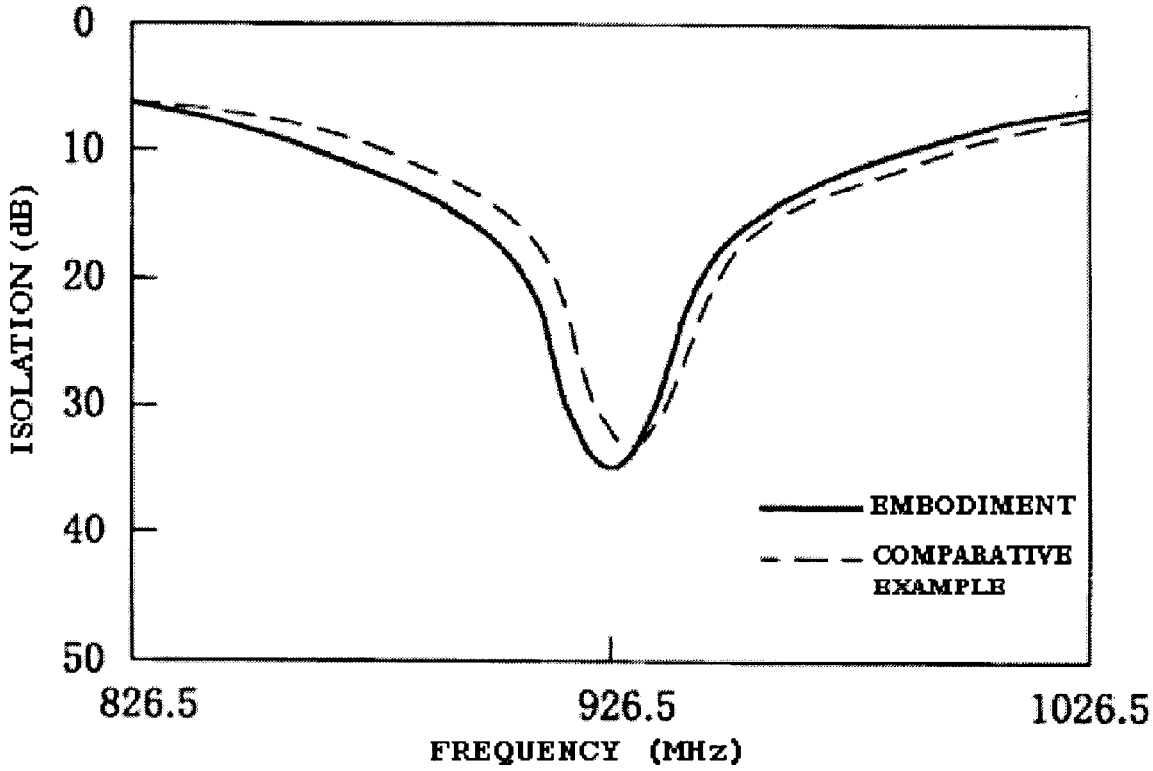
Figure 5A:
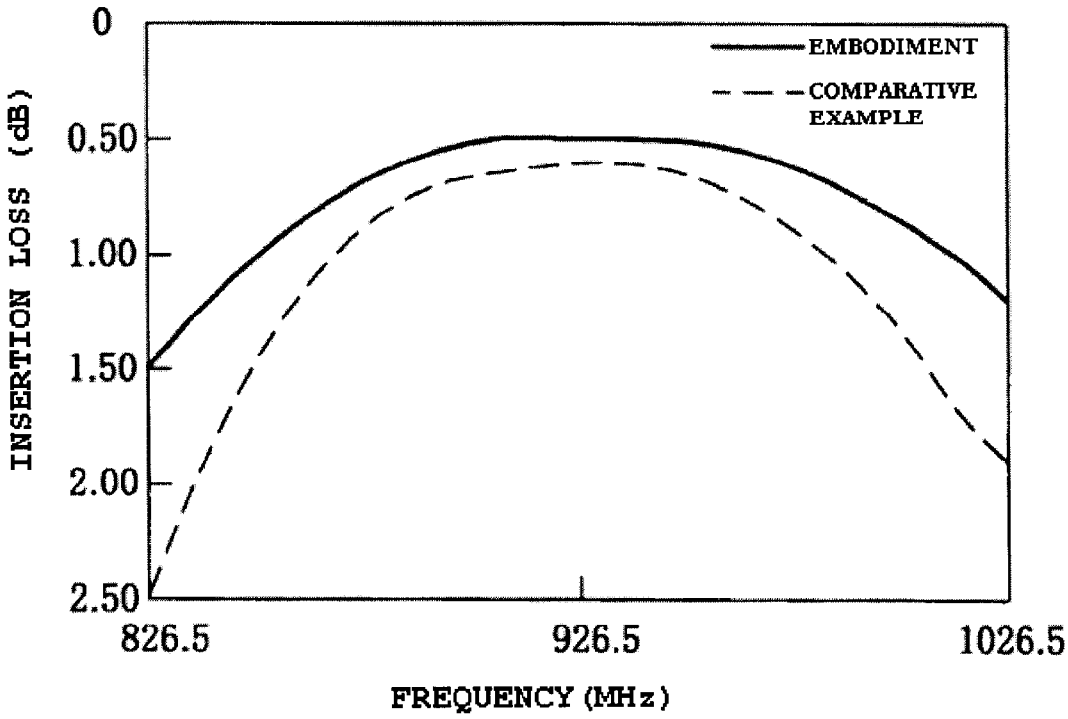
FIGS. 5A and 5B are graphs showing the frequency characteristics of the insertion loss and the output return loss, respectively, of the isolator of a preferred embodiment of the present invention and a comparative example.
Figure 5B:
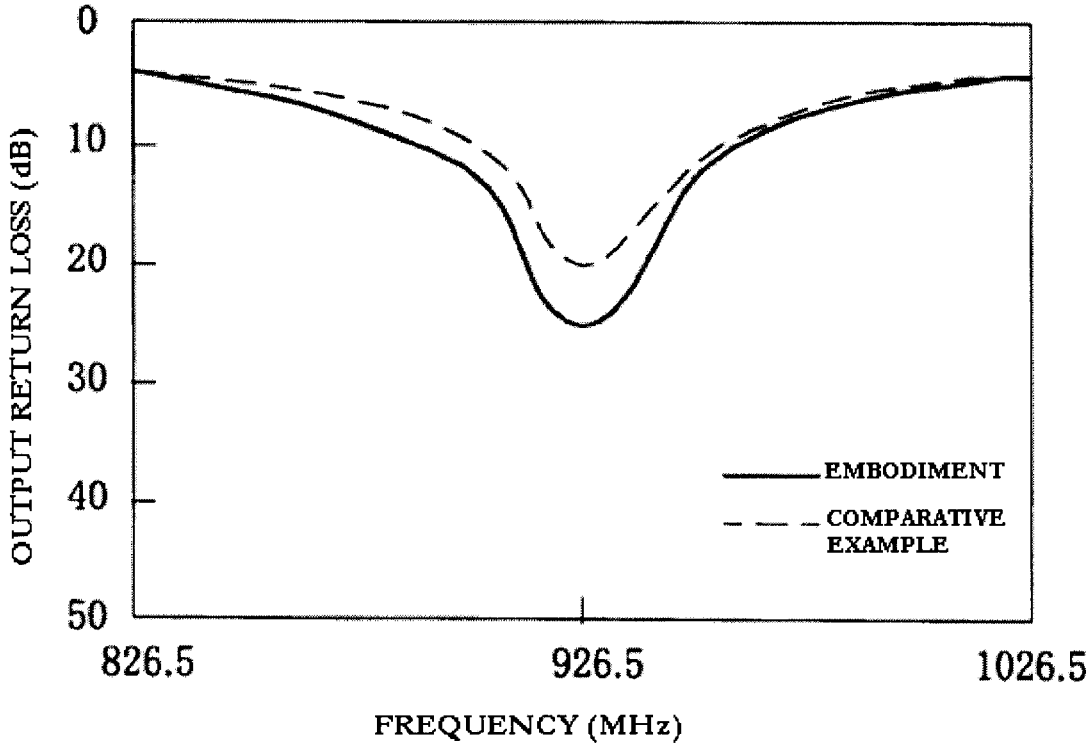

FIG. 1 is an exploded perspective view of an isolator, FIG. 2 is a sectional plan view thereof, and FIG. 3 is an equivalent circuit diagram thereof.

Referring to FIGS. 1 to 3, reference numeral 1 indicates a ferrite member, 2 indicates center conductors (a center conductor 2*a* for an input port, a center conductor 2*b* for an output port, and a center conductor 2*c* for a terminating port), a magnetic assembly 3, a housing 4, an upper yoke 5, a permanent magnet 6, a spacer 7, a lower yoke 8, an input terminal 9, an output terminal 10, ground terminals 11, an input connection plate 12, a resistor R, capacitors $C_0$, $C_1$, $C_2$, and $C_3$, and H indicates the direction of a magnetic field applied to the ferrite member 1.

As shown in FIGS. 1 and 2, the center conductors 2 are defined by the center conductor 2*a* for an input port (input-port center conductor 2*a*), the center conductor 2*b* for an output port (output-port center conductor 2*b*), and the center conductor 2*c* for a terminating port (terminating-port center conductor 2*c*). The center conductors 2*a* to 2*c* are arranged so as to cross one another on the ferrite member 1. The center conductors 2*a* to 2*c* and the ferrite member 1 define the magnetic assembly 3.

The housing 4 is provided with the lower yoke 8, the input terminal 9, the output terminal 10, and the ground terminals 11. The housing 4 includes the magnetic assembly 3, the permanent magnet 6 for applying a static magnetic field to the magnetic assembly 3, the spacer 7 separating the magnetic assembly 3 and the permanent magnet 6, the capacitors $C_0$, $C_1$, $C_2$, and $C_3$, which define matching elements, and the resistor R, which defines a terminating resistor. The upper yoke 5 covers the upper portion of the housing 4.

In the housing 4, the capacitor $C_3$ and the resistor R are connected to one end of the terminating-port center conductor 2*c*. The capacitors $C_1$ and $C_2$ are connected to the input-port center conductor 2*a* and the output-port center conductor 2*b*, respectively. The center conductors 2*a* to 2*c*, the capacitors $C_1$ to $C_3$, and the resistor R are connected to the corresponding ground terminals 11 provided in the housing 4.

An input port 109 is arranged such that one end of the input-port center conductor 2*a* is connected via the capacitor $C_0$ and the input connection plate 12 to the input terminal 9 and the capacitor $C_1$ is connected between the one end of the input-port center conductor 2*a* and the corresponding ground terminal 11. An output port 110 is arranged such that one end of the output-port center conductor 2*b* is connected to the output terminal 10 and the capacitor $C_2$ is connected between the one end of the output-port center conductor 2*b* and the corresponding ground terminal 11. In addition, a terminating port 111 is arranged such that the capacitor $C_3$ and the resistor R are connected in parallel between the terminating-port center conductor 2*c* and the corresponding ground terminals 11.

In this state, an electromagnetic wave entering from the input terminal 9 is output from the output terminal 10, while an electromagnetic wave entering from the output terminal 10 is absorbed by the resistor R of the terminating port 111, and thus, is not output to the input terminal 9, thereby functioning as an isolator.

As shown in FIG. 2, the center conductors 2*a*, 2*b*, and 2*c* are each defined by two parallel conductor elements. Two conductor elements defining the center conductor 2*a* have a greater width than two conductor elements defining each center conductor 2*b* and 2*c*.

That is, the combined total width of the conductor elements defining the input-port center conductor 2*a* is preferably greater than the combined total width of the conductor elements defining each center conductor 2*b* and 2*c*.

With this arrangement, the characteristic impedance of the input-port center conductor 2*a* is reduced, such that the inductance L decreases when the input-port center conductor 2*a* is viewed as a lumped-parameter circuit element. In addition, the series capacitor $C_0$ is added to the input-port center conductor 2*a*, thereby defining a matching circuit of an LC series resonator circuit. A small inductance L and a large capacitance (the value of the capacitor $C_0$) of the series resonator circuit are matched over a wide band. Thus, when a low impedance element, such as a power amplifier, is connected to the input terminal 9, this arrangement provides impedance matching over a wider frequency band, which results in a reduction in the transmission loss of the (electromagnetic) signal.

The parallel capacitors $C_2$ and $C_3$ are respectively connected to the output-port center conductor 2*b* and the terminating-port center conductor 2*c*, thereby defining matching circuits of LC parallel resonator circuits. Typically, an LC parallel resonator circuit provides wide band matching when the inductance L thereof is large and the capacitance (the value of the capacitors $C_2$ and $C_3$) is small.

Thus, the matching circuits provide wide band matching for the respective ports, and thus, the input return loss is reduced over a wide band. Additionally, an input-port center conductor having a wider conductor element or having a larger number of the conductor elements provides a smaller equivalent series resistance, such that loss due to Joule losses is reduced accordingly. This provides an isolator having a low-loss insertion characteristic.

FIGS. 4A, 4B, 5A and 5B show characteristics (the frequency characteristic of the input return loss, isolation, insertion loss, output return loss) of the isolator of this preferred embodiment and an isolator of a comparative example, which includes center conductors having the same width for all of the ports. The center frequency in this case is about 926.5 MHz.

Table 1 shows the specifications of elements of each isolator.

TABLE 1

| | Present Invention | Comparative Example |
|---|---|---|
| Width of each conductor element constituting the input-port center conductor 2a | 0.30 mm | 0.20 mm |
| Width of each conductor element constituting the output-port center conductor 2b | 0.20 mm | |
| Width of each conductor element constituting the terminating-port center conductor 2c | 0.20 mm | |
| Gap between conductor elements constituting the input-port center conductor 2a | 0.10 mm | 0.30 mm |
| Gap between conductor elements constituting the output-port center conductor 2b | 0.30 mm | |
| Gap between conductor elements constituting the terminating-port center conductor 2c | 0.30 mm | |
| Matching Capacitance $C_0$ | 6.0 pF | 5.0 pF |
| Matching Capacitance $C_1$ | 5.5 pF | 6.5 pF |
| Matching Capacitance $C_2$ | 10.5 pF | |
| Matching Capacitance $C_3$ | 15.0 pF | |
| Terminating Resistance | 56 Ω | |
| Dimensions of Ferrite member | 3.00 × 3.00 × 0.50 mm | |

As shown in FIGS. 4A, 4B, 5A, and 5B, the isolator of this preferred embodiment reduces the transmission loss over a wide frequency band as compared to the isolator of the comparative example.

An isolator according to a second preferred embodiment will now be described with reference to FIGS. 6A and 6B.

Figure 6A:
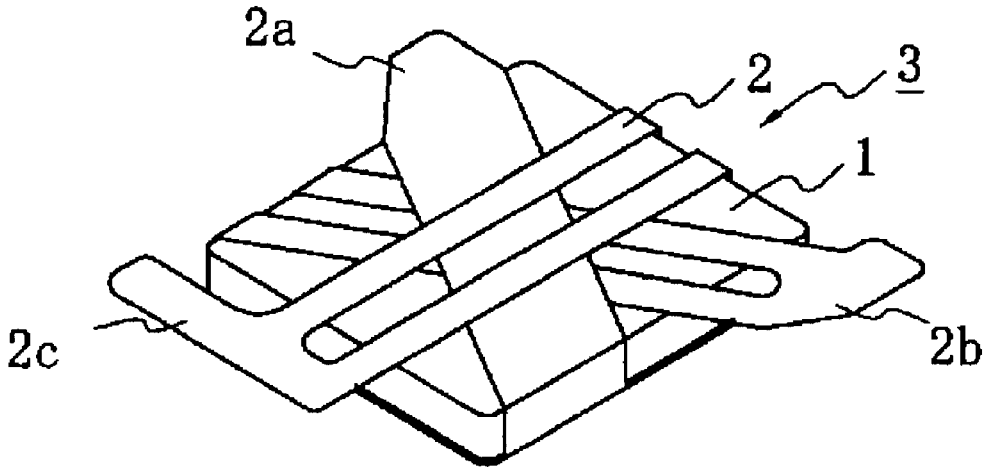
FIGS. 6A and 6B are a perspective view and a plan view, respectively, of a magnetic assembly of an isolator according to a second preferred embodiment of the present invention.
Figure 6B:
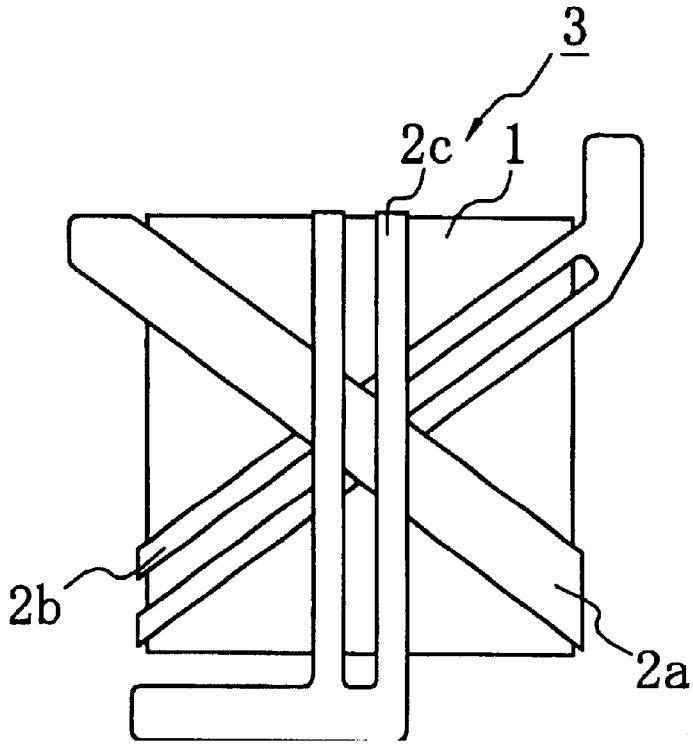

FIGS. 6A and 6B are a perspective view and a plan view, respectively, of a magnetic assembly of the isolator of the second preferred embodiment.

Referring to FIGS. 6A and 6B, a magnetic assembly 3 includes a ferrite member 1 and center conductors 2, which are defined by an input-port center conductor 2*a*, an output-port center conductor 2*b*, a terminating-port center conductor 2*c*, and portions providing electrical connections therebetween. The center conductors 2*a* to 2*c* are arranged on the ferrite member 1 so as to cross one another.

The input-port center conductor 2*a* of the magnetic assembly 3 of this preferred embodiment is defined by a single conductor element having an increased width, as shown in FIGS. 6A and 6B. The width of the input-port center conductor 2*a* is preferably greater than the combined total width of the two conductor elements defining each center conductor 2*b* and 2*c*. The remaining elements and arrangement of elements of this preferred embodiment are analogous to those of the magnetic assembly 3 and the isolator of the first preferred embodiment shown in FIG. 1.

With this arrangement, the characteristic impedance decreases when the input-port center conductor 2*a* is viewed as a line, and the inductance L decreases when the input-port center conductor 2*a* is viewed as a lumped-parameter circuit element, thereby providing wide band matching. In addition, the equivalent series resistance is reduced accordingly, thereby reducing the loss.

An isolator according to a third preferred embodiment will now be described with reference to FIGS. 7A and 7B.

Figure 7A:
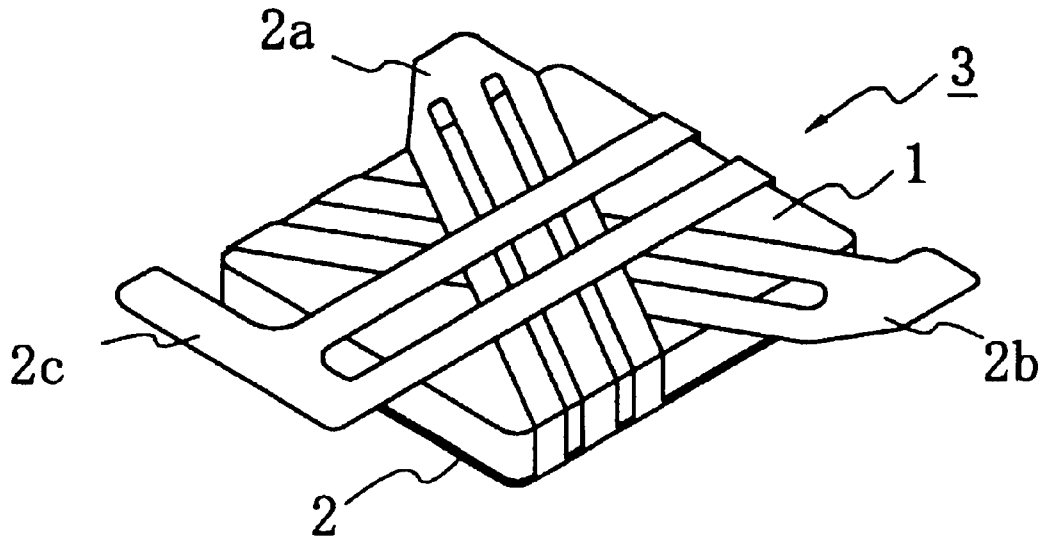
FIGS. 7A and 7B are a perspective view and a plan view, respectively, of a magnetic assembly of an isolator according to a third preferred embodiment of the present invention.
Figure 7B:
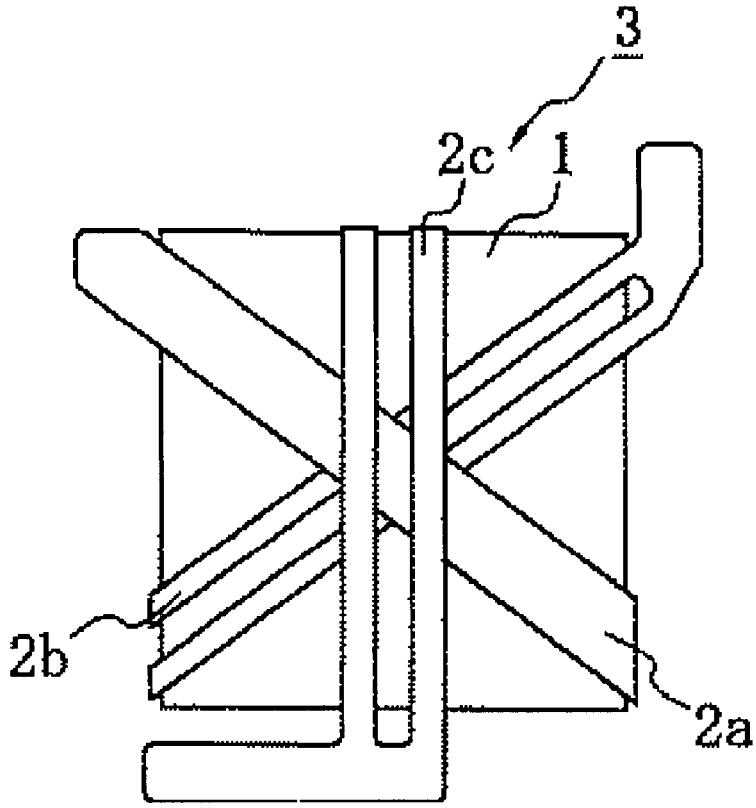

FIGS. 7A and 7B are a perspective view and a plan view, respectively, of a magnetic assembly of the isolator of the third preferred embodiment.

Referring to FIGS. 7A and 7B, a magnetic assembly 3 includes a ferrite member 1 and center conductors 2, which are defined by an input-port center conductor 2*a*, an output-port center conductor 2*b*, a terminating-port center conductor 2*c*, and portions providing electrical connections therebetween. The center conductors 2*a* to 2*c* are arranged on the ferrite member 1 so as to cross one another.

The input-port center conductor 2*a* of the magnetic assembly 3 of this preferred embodiment preferably includes three conductor elements, as shown in FIGS. 7A and 7B, and the combined total width of the three conductor elements is greater than the combined total width of the two conductor elements defining each center conductor 2*b* and 2*c*. The remaining elements and arrangement of elements of this preferred embodiment are analogous to those of the magnetic assembly 3 and the isolator of the first preferred embodiment shown in FIG. 1.

This arrangement reduces the characteristic impedance when the input-port center conductor 2*a* is viewed as a line, and thus, provides the same advantages as those of the first and second preferred embodiments described above.

An isolator according to a fourth preferred embodiment will now be described with reference to FIGS. 8A and 8B.

Figure 8A:
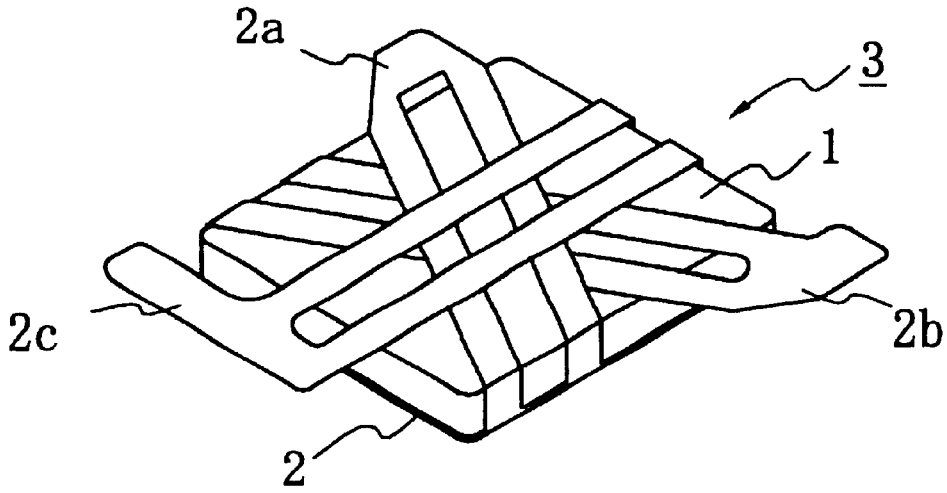
FIGS. 8A and 8B are a perspective view and an enlarged side view, respectively, of a magnetic assembly of an isolator according to a fourth preferred embodiment of the present invention.
Figure 8B:
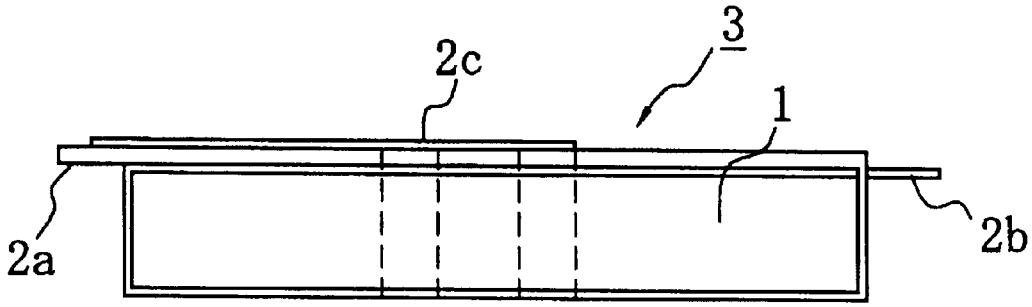

FIGS. 8A and 8B are a perspective view and an enlarged side view, respectively, of a magnetic assembly of the isolator of the fourth preferred embodiment.

Referring to FIGS. 8A and 8B, a magnetic assembly 3 includes a ferrite member 1 and center conductors 2, which are defined by an input-port center conductor 2*a*, an output-port center conductor 2*b*, an terminating-port center conductor 2*c*, and portions providing electrical connections therebetween. The center conductors 2*a* to 2*c* are arranged on the ferrite member 1 so as to cross one another.

The input-port center conductor 2*a* of the magnetic assembly 3 of this preferred embodiment, shown in FIGS. 8A and 8B, has a thickness that is greater than that of each center conductors 2*b* and 2*c*. The remaining elements and arrangement of elements of this preferred embodiment are analogous to those of the magnetic assembly 3 and the isolator of the first preferred embodiment shown in FIG. 1.

With this arrangement, the characteristic impedance of the input-port center conductor 2*a* is reduced without varying the number of conductor elements defining the input-port center conductor 2*a*, which provides the same advantages as the first, second and third preferred embodiments described above.

While the isolator in each preferred embodiment described above is arranged such that the center conductors cross one another on the ferrite member and the matching elements are connected thereto, the present invention is not limited thereto. For example, the center conductors may be defined by conductor films on the ferrite member, and/or a through hole or via hole may be provided in the center conductors. In addition, a laminated substrate in which thin-film electrode layers are laminated between dielectric layers may be provided as the center conductor on the surface of the ferrite member. The center conductor may also be formed in such a manner that thick-film electrodes (conductor films) and dielectric films are alternately superimposed on the surface of the ferrite member.

Additionally, the capacitor may be a single-plate capacitor having electrodes on two opposing surfaces of a dielectric, or may be a stacked capacitor. Alternatively, the capacitor may include electrodes provided on two opposing surfaces of a single dielectric substrate or may include multiple electrodes provided between two opposing surfaces thereof. The center conductors, matching capacitors, resistor, and terminals may be defined by a single dielectric block. In such a case, the dielectric material is not limited to ferrite and may be a nonmagnetic dielectric.

In each of the isolators of preferred embodiments described above, setting the shape and configuration of the input-port center conductor 2*a* to have an input impedance of about 3Ω to about 30Ω can facilitate impedance matching with a typical high-frequency power amplifier and a filter circuit, thereby allowing low-loss transmission of a signal to the isolator.

On the other hand, configuring the output-port center conductor 2*b* to have a characteristic impedance of about 50Ω permits matching with elements, such as an antenna duplexer and antenna, thereby allowing low-loss output of a signal from the isolator.

Similarly, in a nonreciprocal circuit device such as a circulator having no terminating resistor, setting the input impedance of the input port to about 3Ω to about 30Ω and setting the characteristic impedance of the other ports to about 50Ω provides low-loss signal transmission.

Figure 9:
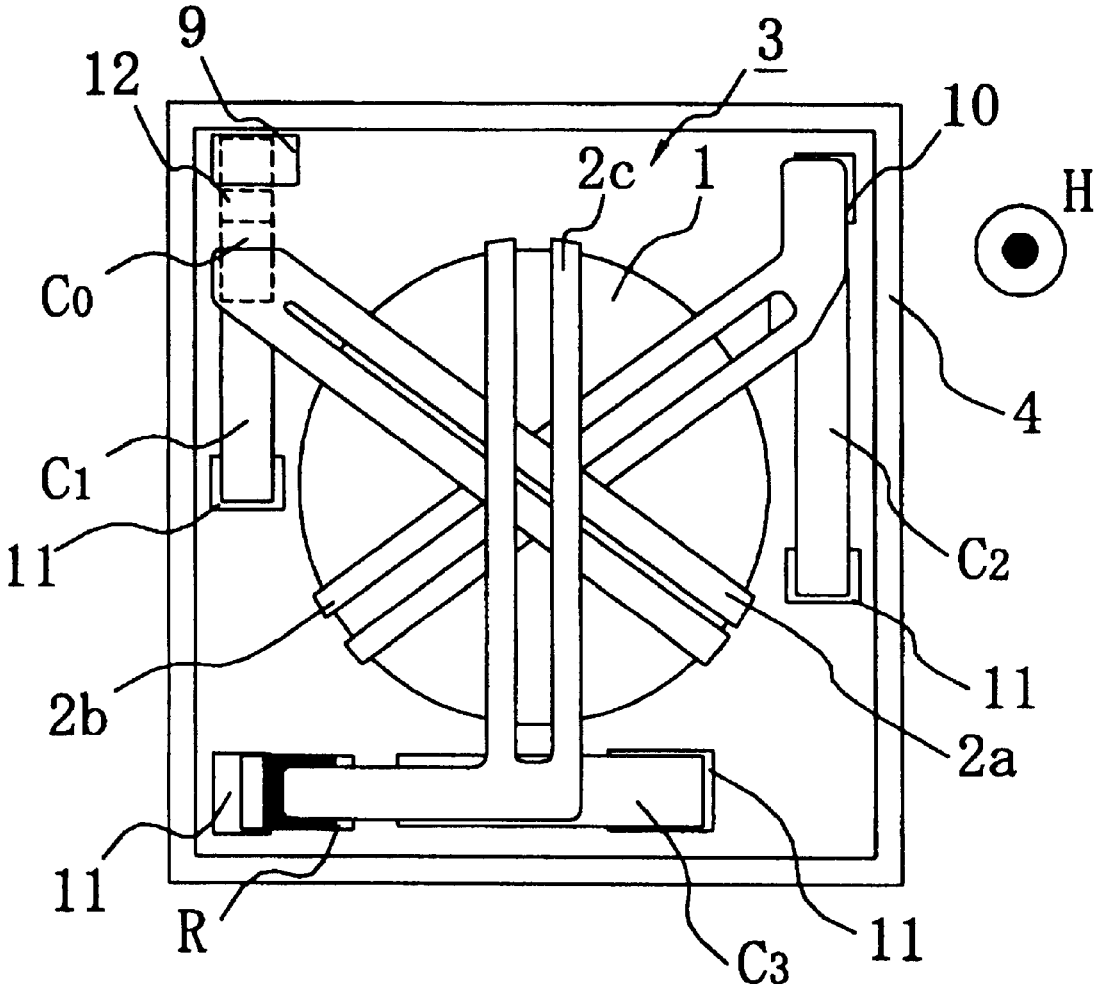
FIG. 9 is a sectional plan view of an isolator with a circular-plate ferrite member.

While a substantially rectangular ferrite member is used in the above-described preferred embodiments, the present invention is not limited thereto. For example, the use of a substantially circular-plate ferrite member as shown in FIG. 9 or a polygonal ferrite member (not shown) can provide the same advantage. The same is true of the shape of the permanent magnet provided above the ferrite member with the spacer therebetween.

A communication apparatus according to a fifth preferred embodiment will now be described with reference to FIG. 10.

Figure 10:
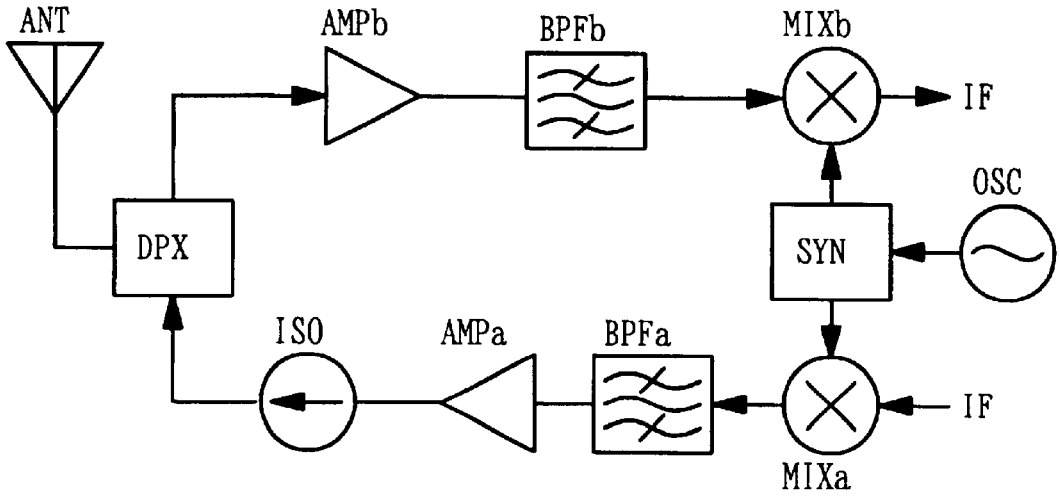
FIG. 10 is a block diagram of a communication apparatus according to a fifth preferred embodiment of the present invention.
Figure 11:
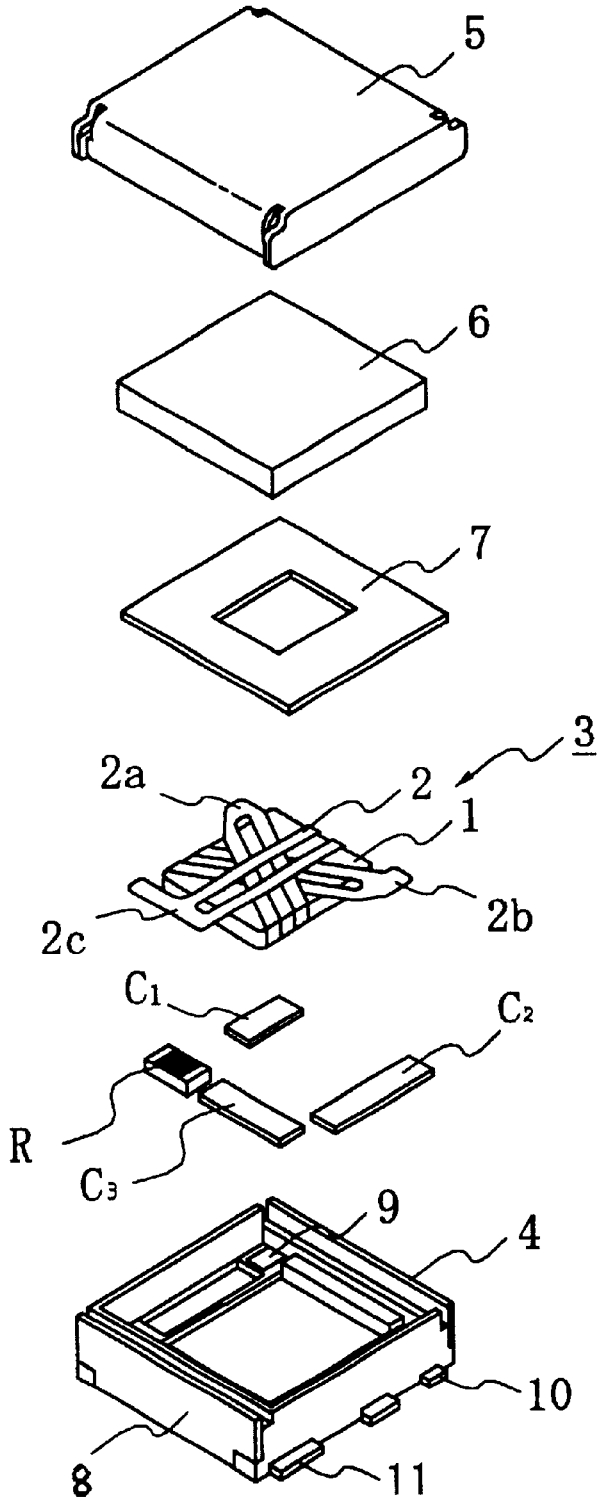
Fig. 11 PRIOR ART
FIG. 11 is an exploded perspective view of an isolator of the related art.
Figure 12A:
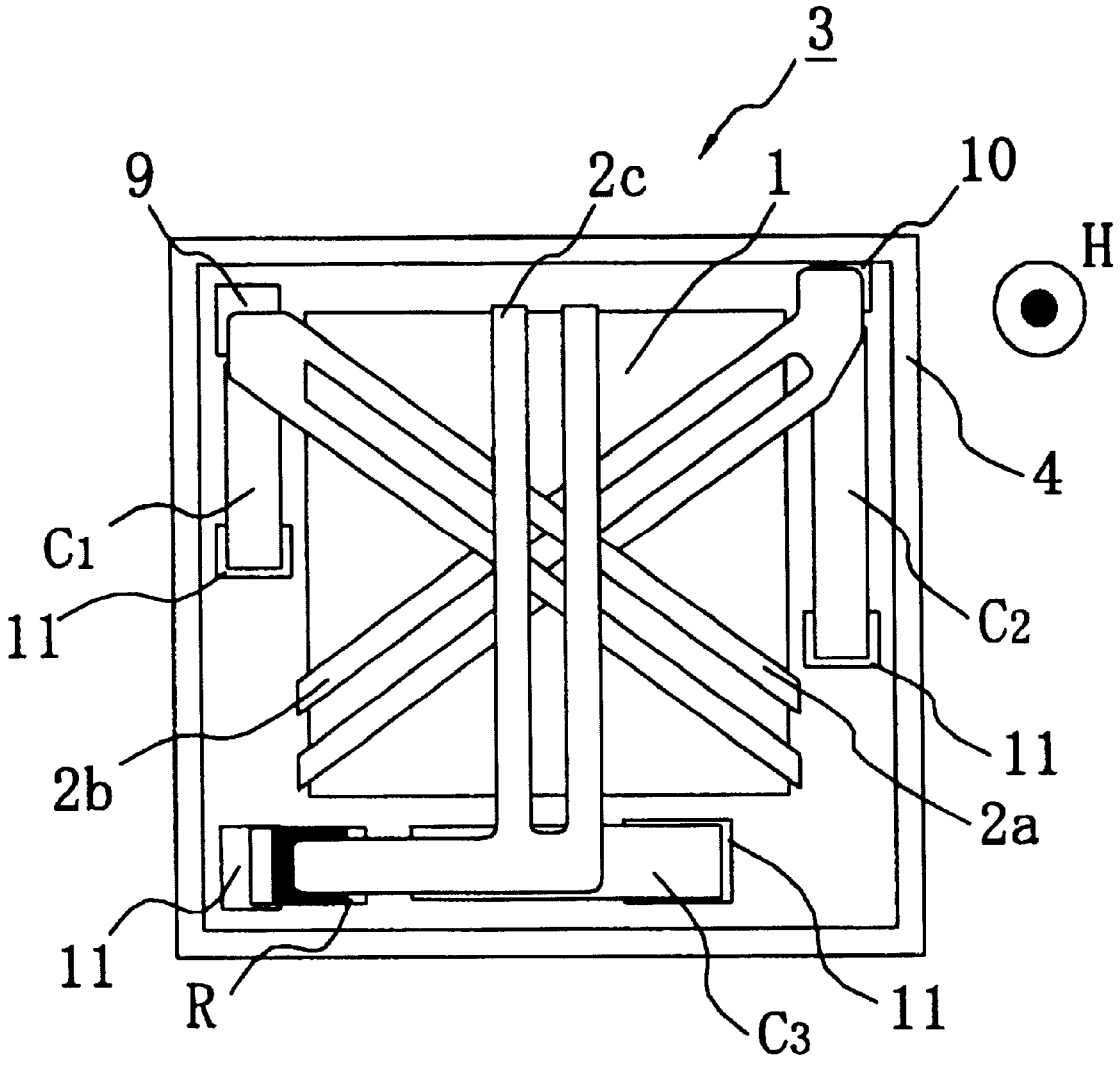
Fig. 12A PRIOR ART
FIGS. 12A and 12B are a sectional plan view and an equivalent circuit diagram, respectively, of the isolator of the related art.
Figure 12B:
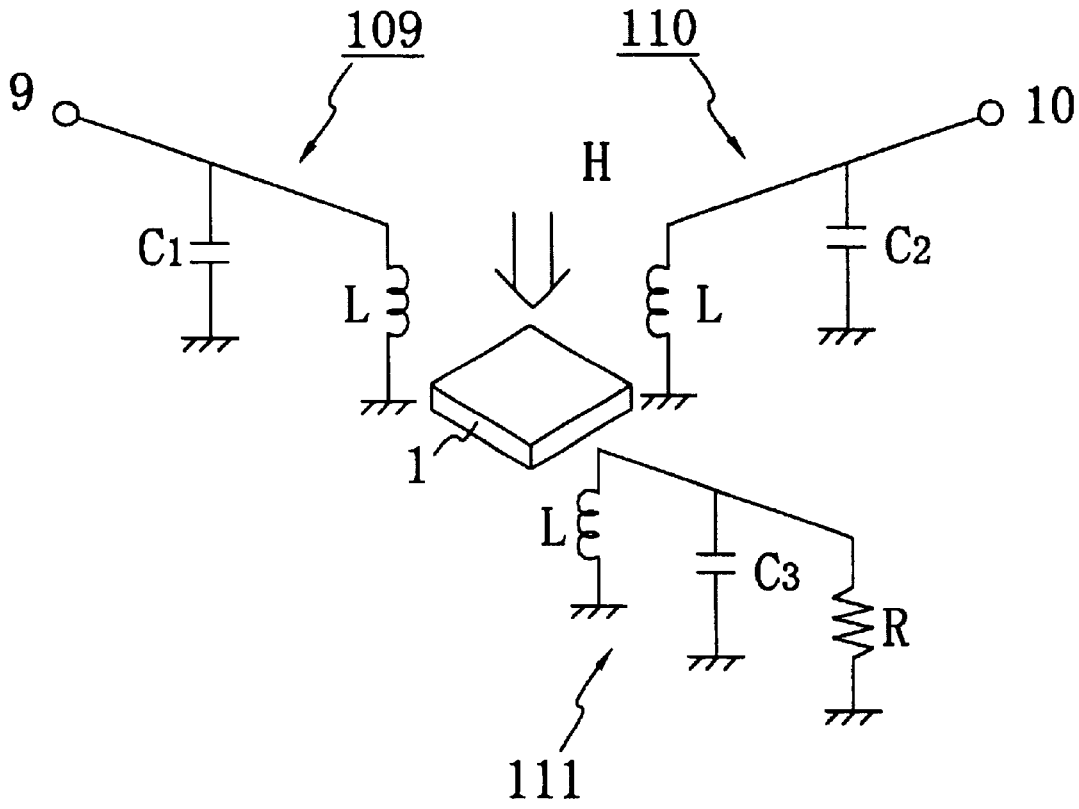
Fig. 12B PRIOR ART

FIG. 10 is a block diagram of a communication apparatus.

In FIG. 10, reference symbol ANT indicates a transmitting/receiving antenna, DPX is a duplexer, BPFa and BPFb are bandpass filters, AMPa and AMPb are amplifying circuits, MIXa and MIXb are mixers, OSC is an oscillator, SYN is a frequency synthesizer, and ISO is an isolator.

The mixer MIXa mixes an input intermediate frequency signal IF and a signal output from the frequency synthesizer SYN. Of mixed signals output from the mixer MIXa, the bandpass filter PBFa permits passing of a signal within a transmission frequency band only, and the amplifying circuit AMPa amplifies the power of the signal. The antenna ANT transmits a signal sent through the isolator ISO and the oscillator OSC. The isolator ISO blocks a return signal from the duplexer DPX to the amplifying circuit AMPa. The amplifying circuit AMPb amplifies a signal received from the duplexer DPX, thereby preventing generation of a skew signal. The bandpass filter BPFb permits passing of a signal only within a reception frequency band out of a signal output from the amplifying circuit AMPb. The mixer MIXb mixes a frequency signal output from the frequency synthesizer SYN and a signal received from the bandpass filter BPFb to output an intermediate frequency signal IF.

In this preferred embodiment, the nonreciprocal circuit device, i.e., the isolator, described in the first to fourth preferred embodiments is provided as the isolator ISO shown in FIG. 10.

Thus, the use of the low-loss isolator provides a communication apparatus having greatly improved transmission characteristics.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A nonreciprocal circuit device comprising:

a magnetic assembly including a ferrite member, and a center conductor for an input port and center conductors for other ports which are provided on the ferrite member so as to cross one another;

a permanent magnet for applying a static magnetic field to the magnetic assembly; and matching circuits connected to the corresponding center conductors; wherein when the center conductors for the input port and the other ports are viewed as lines, the characteristic impedance of the center conductor for the input port is less than that of the center conductors for the other ports; and the width of the center conductor for the input port is greater than the width of the center conductors for the other ports.

2. A nonreciprocal circuit device according to claim 1, wherein the matching circuit connected to the center conductor for the input port includes a series capacitor connected in series to the center conductor for the input port and a parallel capacitor connected between the center conductor for the input port and a ground electrode.

3. A nonreciprocal circuit device according to claim 1, wherein the center conductor for the input port includes a single conductor element that extends in the width direction thereof, the center conductors for the other ports each includes a plurality of conductor elements that are substantially parallel to each other, and the width of the single conductor element defining the center conductor for the input port is greater than the combined total width of the conductor elements constituting each of the center conductors for the other ports.

4. A nonreciprocal circuit device according to claim 2, wherein the center conductor for the input port includes a single conductor element that extends in the width direction thereof, the center conductors for the other ports each includes a plurality of conductor elements that are substantially parallel to each other, and the width of the single conductor element defining the center conductor for the input port is greater than the combined total width of the conductor elements constituting each of the center conductors for the other ports.

5. A nonreciprocal circuit device according to claim 1, wherein the center conductors for the input port and for the other ports each includes a plurality of conductor elements that are substantially parallel to each other, the number of conductor elements defining the center conductor for the input port is greater than the number of conductor elements defining each of the center conductors for the other ports, and the combined total width of the conductor elements defining the center conductor for the input port is greater than the combined total width of the conductor elements defining each of the center conductors for the other ports.

6. A nonreciprocal circuit device according to claim 2, wherein the center conductors for the input port and for the other ports each includes a plurality of conductor elements that are substantially parallel to each other, the number of conductor elements defining the center conductor for the input port is greater than the number of conductor elements defining each of the center conductors for the other ports, and the combined total width of the conductor elements defining the center conductor for the input port is greater than the combined total width of the conductor elements defining each of the center conductors for the other ports.

7. A nonreciprocal circuit device according to claim 1, wherein the center conductor for the input port has a thickness greater than the thickness of the center conductors for the other ports.

8. A nonreciprocal circuit device according to claim 2, wherein the center conductor for the input port has a thickness greater than the thickness of the center conductors for the other ports.

9. A nonreciprocal circuit device according to claim 1, wherein the characteristic impedance of the center conductor for the input port is about 3Ω to about 30Ω.

10. A nonreciprocal circuit device according to claim 2, wherein the characteristic impedance of the center conductor for the input port is about 3Ω to about 30Ω.

11. A nonreciprocal circuit device according to claim 1, wherein the characteristic impedance of the center conductors for the other ports is about 50Ω.

12. A nonreciprocal circuit device according to claim 2, wherein the characteristic impedance of the center conductors for the other ports is about 50Ω.

13. A nonreciprocal circuit device according to claim 1, wherein one of the center conductors for the other ports is terminated.

14. A nonreciprocal circuit device according to claim 2, wherein one of the enter conductors for the other ports is terminated.

15. A communication apparatus comprising a nonreciprocal circuit device according to claim 1.

16. A communication apparatus comprising a nonreciprocal circuit device according to claim 2.

* * * * *